US009389533B2

(12) United States Patent
Nakahata et al.

(10) Patent No.: US 9,389,533 B2
(45) Date of Patent: Jul. 12, 2016

(54) IMAGE FORMING APPARATUS CAPABLE OF CORRECTING POSITION OF IMAGE TO BE FORMED

(71) Applicant: CANON KABUSHIKI KAISHA, Tokyo (JP)

(72) Inventors: Hiroshi Nakahata, Abiko (JP); Toshiharu Mamiya, Yokohama (JP); Yuta Okada, Moriya (JP); Shinichiro Hosoi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/689,297

(22) Filed: Apr. 17, 2015

(65) Prior Publication Data

US 2015/0301471 A1 Oct. 22, 2015

(30) Foreign Application Priority Data

Apr. 22, 2014 (JP) ..... 2014-088457

(51) Int. Cl.

| | |
|---|---|
| ***G03G 15/043*** | (2006.01) |
| ***G03G 15/01*** | (2006.01) |
| ***G03G 15/00*** | (2006.01) |
| ***G03G 15/20*** | (2006.01) |

(52) U.S. Cl.

CPC ..... *G03G 15/043* (2013.01); *G03G 15/0189* (2013.01); *G03G 15/5058* (2013.01); *G03G 15/20* (2013.01); *G03G 2215/0161* (2013.01)

(58) Field of Classification Search

CPC ..... G03G 15/043

See application file for complete search history.

(56) References Cited

U.S. PATENT DOCUMENTS

2011/0007120 A1* 1/2011 Motoi ..... G03G 15/0415 347/116

2014/0064800 A1* 3/2014 Sato ..... G03G 15/0189 399/301

FOREIGN PATENT DOCUMENTS

JP 200611289 A 1/2006

* cited by examiner

*Primary Examiner* — Sandra Brase

(74) *Attorney, Agent, or Firm* — Rossi, Kimms & McDowell LLP

(57) ABSTRACT

An image forming apparatus capable of controlling an image forming position with high accuracy. The image forming apparatus has a plurality of image forming sections each including a photosensitive drum and a laser scanner. The laser scanner exposes the photosensitive drum to form an electrostatic latent image thereon. The image forming section develops the electrostatic latent image formed on the photosensitive drum to form a toner image, and the toner image is transferred onto an intermediate transfer belt. A thermistor in the laser scanner detects the internal temperature of the laser scanner. The image forming apparatus controls the image forming sections to form detection patterns on the intermediate transfer belt. An image forming position is corrected based on the temperature detected by the thermistor and a result of measurement of the detection patterns.

10 Claims, 9 Drawing Sheets

IMAGE FORMING APPARATUS CAPABLE OF CORRECTING POSITION OF IMAGE TO BE FORMED

BACKGROUND OF THE INVENTION

1. Field of the Invention

The present invention relates to a correction technique of an image forming apparatus for correcting a position of an image to be formed.

2. Description of the Related Art

Conventionally, there have been widely known copying machines, printers, and the like image forming apparatuses each of which uses an electrophotographic method to form color images.

In general, the temperature of an electrophotographic image forming apparatus rises due to heat from various motors including a polygon motor, a fixing heater, a power supply, and so forth, which act as heat sources after the startup of the apparatus, and/or change in ambient environment. In such an image forming apparatus, temperature rise in its apparatus body, particularly in a scanning optical device, causes variation in the irradiation position of a light beam, which is emitted from the scanning optical device, on the surface of a photosensitive drum, and as a consequence, the position of an electrostatic latent image formed on the photosensitive drum changes. For example, in an image forming apparatus which forms a color image by superimposition of images formed on a color component-by-color component basis, when the color-component images are positionally shifted from each other, color misregistration is caused in the color image. The variation of the irradiation position occurs depending on a change in the temperature of the image forming apparatus including the scanning optical device, and continues until the temperature of the image forming apparatus becomes constant.

Factors responsible for occurrence of the variation of the irradiation position include, for example, (a) change in the refractive index of a lens disposed in the scanning optical device and wavelength variation of a semiconductor laser due to temperature rise. The above-mentioned change and variation due to temperature rise change the irradiation position and characteristic values including total magnification. Also, locations of optical members including mirrors and lenses arranged in a casing (optical box) of the scanning optical device change due to (b) thermal expansion of the optical box, which can cause a change in the irradiation position of a light beam on the photosensitive drum. Also, the relative position between the photosensitive drum and a light beam can vary due to (c) thermal expansion of a support member for supporting the photosensitive drum. Further, the revolution speed of the photosensitive drum and the conveying speed of a transfer member can vary due to (d) expansion of a driving roller and the like, which sometimes causes variation in relative position between images formed by a plurality of image forming sections, respectively. Especially, the factors (a) and (b) are dominant ones crucial to the variation in the irradiation position. For this reason, there has been proposed an image forming apparatus that controls total magnification, a writing start position in the main scanning direction, a writing start position in the sub scanning direction, the inclination of a scanning line, and so forth, according to a change in the temperature of a scanning optical device. In this scanning optical device, e.g. a temperature in the vicinity of a polygon mirror is detected as the temperature of the scanning optical device.

As such an image forming apparatus, there has been proposed, for example, an image forming apparatus that detects the temperature of a scanning optical device by a temperature detecting element provided in the casing of the scanning optical device when the power is turned on, predicts the amount of shift of the irradiation position of a light beam based on the detected temperature, and controls the light beam based on the predicted shift amount (see Japanese Patent Laid-Open Publication No. 2006-11289).

However, the image forming apparatus proposed in Japanese Patent Laid-Open Publication No. 2006-11289 suffers from the following problem: In a state in which a polygon motor has not been warmed yet immediately after the start of rotation of the polygon mirror, the detected temperature is temporarily lowered by airflow generated by the rotation of the polygon mirror. For this reason, there is a possibility that the temperature detected immediately after the start of rotation of the polygon mirror becomes lower than the internal temperature of the scanning optical device. This makes it impossible to control, with high accuracy, the position of an image formed immediately after the start of rotation of the polygon mirror.

SUMMARY OF THE INVENTION

The invention provides an image forming apparatus that is capable of controlling the position of an image to be formed, with high accuracy, even when the detected temperature of an exposure device is lowered by rotation of a polygon mirror.

The invention provides an image forming apparatus comprising an image forming unit that includes a plurality of photosensitive members and an exposure device for exposing each of the photosensitive members so as to form an electrostatic latent image thereon, and is configured to form a plurality of toner images by developing the electrostatic latent images formed on the respective photosensitive members by the exposure device, a transfer unit configured to transfer the toner images formed by the image forming unit onto an image bearing member, a sensor configured to detect a temperature of the exposure device, a measurement unit configured to measure a measurement image formed on the image bearing member, a first determination unit configured to control the exposure device and the transfer unit to cause the measurement image to be formed on the image bearing member, and determine a first registration adjustment condition based on a result of measurement by the measurement unit, a second determination unit configured to determine a second registration adjustment condition based on a temperature detected by the sensor when the measurement image is formed and a temperature detected by the sensor when the toner images are formed, and a controller configured to execute registration adjustment processing for the toner images based on the first registration adjustment condition determined by the first determination unit in a case where the temperature detected by the sensor is lowering during a time period for formation of the toner images, and executes the registration adjustment processing based on the first registration adjustment condition determined by the first determination unit and the second registration adjustment condition determined by the second determination unit in a case where the temperature detected by the sensor is rising during the time period.

According to the invention, even when the detected temperature of the exposure device is lowered by rotation of the polygon mirror, it is possible to control the position of an image to be formed, with high accuracy.

Further features of the present invention will become apparent from the following description of exemplary embodiments (with reference to the attached drawings).

DESCRIPTION OF THE EMBODIMENTS

The present invention will now be described in detail below with reference to the accompanying drawings showing an embodiment thereof.

Figure 1:
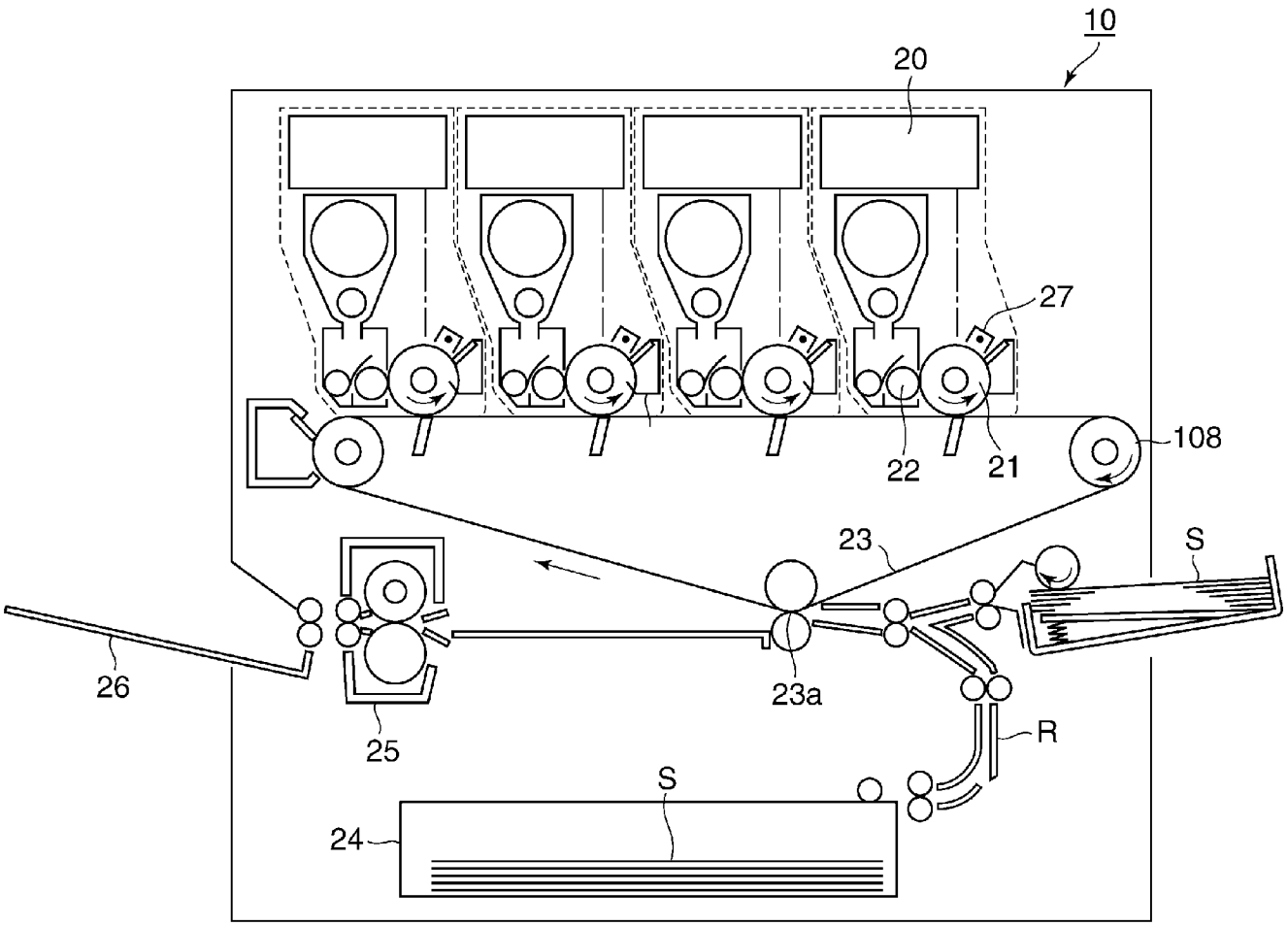
FIG. 1 is a schematic cross-sectional view of an image forming apparatus.

FIG. 1 is a schematic cross-sectional view of a color image forming apparatus according to the embodiment of the invention. This image forming apparatus is an electrophotographic one having a plurality of image forming sections.

Referring to FIG. 1, the image forming apparatus 10 includes a plurality of image forming sections each comprised of a photosensitive drum 21, a developing device 22, and an electrostatic charger 27, and a plurality of scanning optical devices 20 each for irradiating the photosensitive drum 21 of a corresponding one of the image forming sections with a laser beam (light beam) to thereby form an electrostatic latent image thereon.

Further, the image forming apparatus 10 includes an intermediate transfer belt 23 disposed below the image forming sections, a fixing device 25, a discharge tray 26, and a sheet feed cassette 24 disposed below the intermediate transfer belt 23.

The photosensitive drum 21 is a photosensitive member formed by applying a photosensitive layer to a conductor, and is rotated by a motor, not shown. The electrostatic charger 27 uniformly charges the surface of the photosensitive drum 21. The scanning optical device 20 emits light beams based on image data sent e.g. from an image reader, not shown, or a personal computer to thereby scan the charged surface of the photosensitive drum 21. Thus, an electrostatic latent image is formed on the surface of the photosensitive drum 21.

The scanning optical device 20 is equipped with a multi-beam laser for emitting a plurality of light beams. The developing device 22 develops an electrostatic latent image on the photosensitive drum 21 using toner. This forms a toner image on the photosensitive drum 21.

The sheet feed cassette 24 stores a plurality of sheets S. The sheets S stored in the sheet feed cassette 24 are fed by a sheet feed unit, not shown, and are conveyed to a transfer section 23*a* of the intermediate transfer belt 23 via a conveying path R.

Toner images on the respective photosensitive drums 21 are transferred onto the intermediate transfer belt 23 in superimposed relation, whereby a color image is formed on the intermediate transfer belt 23. The color image formed on the intermediate transfer belt 23 is transferred onto a sheet S supplied from the sheet feed cassette 24.

The fixing device 25 thermally fixes the color image transferred onto the sheet S. The discharge tray 26 receives the sheet S which has the color image fixed thereon and is discharged.

Figure 2A:
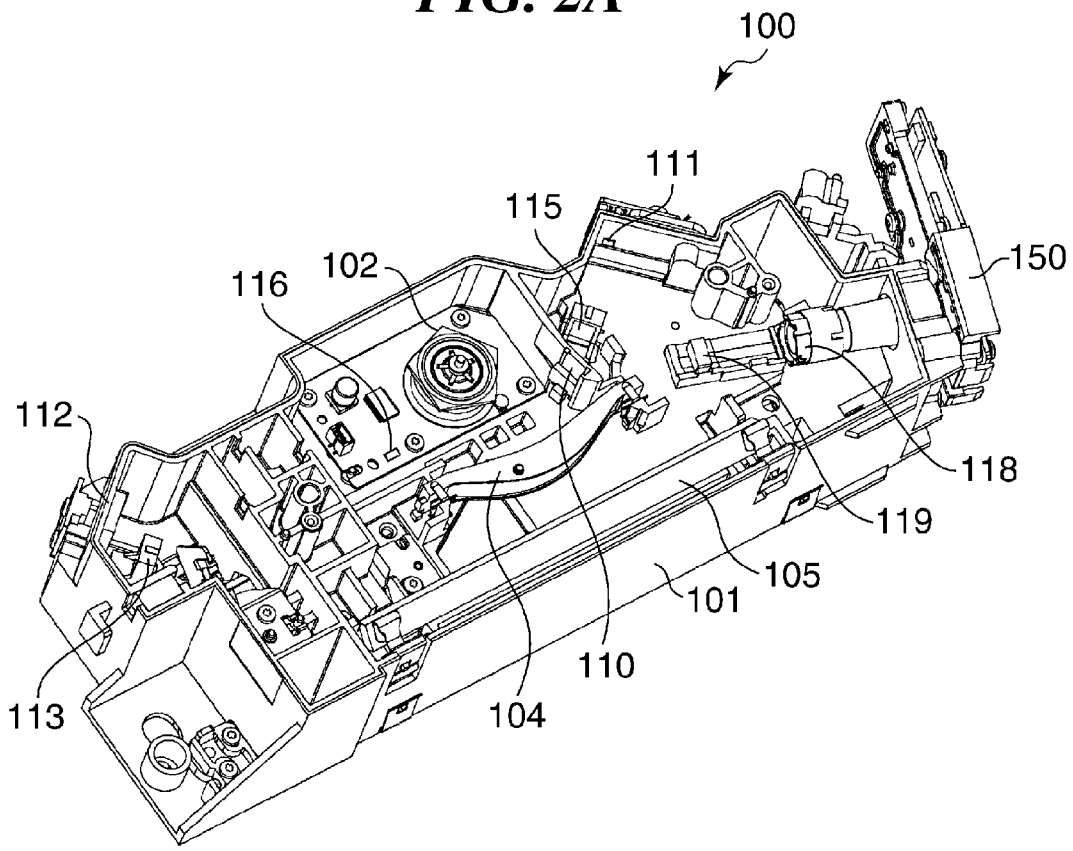
FIG. 2A is a perspective view of a scanning optical device with its lid removed therefrom.
Figure 2B:
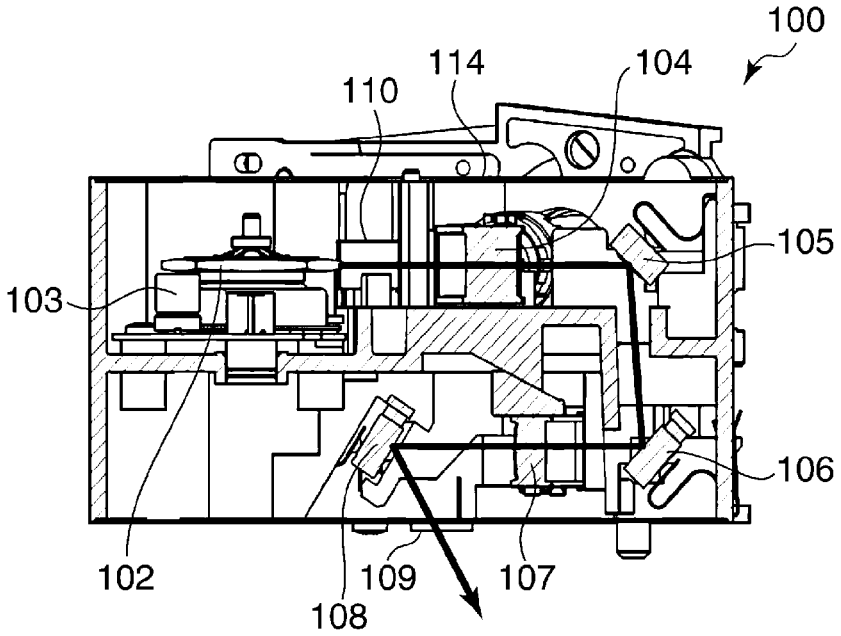
FIG. 2B is a partial cross-sectional view of essential parts of the scanning optical device.

FIGS. 2A and 2B are views useful in explaining the scanning optical device 20 appearing in FIG. 1. FIG. 2A is a perspective view of the scanning optical device 20 with its lid removed therefrom, and FIG. 2B is a partial cross-sectional view of essential parts of the scanning optical device 20.

Referring to FIGS. 2A and 2B, a scanning optical device (hereinafter referred to as "the laser scanner") 100 is applied e.g. to a color image forming apparatus having a plurality of image forming sections, such as the image forming apparatus according to the present embodiment, and functions as an exposure device for exposing the surface of each photosensitive member. The laser scanner 100 is comprised of an optical box 101 as a casing and a light source unit 150 attached to the optical box 101.

The optical box 101 as a casing accommodates a polygon mirror 102 that deflects a light beam emitted from a laser light source of the light source unit 150 such that the light beam scans the corresponding photosensitive drum 21 in a predetermined direction. The polygon mirror 102 is integrally provided with a polygon motor 103 as a drive source of the polygon mirror 102. On an optical path between the laser light source of the light source unit 150 and the polygon mirror 102, there are arranged a collimator lens 118, a cylindrical lens 119, and a beam splitter 110.

On an optical path of a first light beam having passed through the beam splitter 110 and deflected by the polygon mirror 102, there are arranged a first fθ lens 104, a reflection mirror 105, a reflection mirror 106, a second fθ lens 107, a reflection mirror 108, and a dustproof glass 109.

The first fθ lens 104 is disposed closer to the polygon mirror 102 than the second fθ lens 107 is. A light beam reflected on the reflection mirror 108 passes through the dustproof glass 109 and is irradiated onto the photosensitive drum 21.

On the other hand, on an optical path of a second light beam reflected on the beam splitter 110, there are arranged a condenser lens 115 and a photodiode (PD) 111 as a photoelectric conversion element (light receiving section).

Further, in the optical box 101, there are provided a beam detector (hereinafter referred to as "the BD") 112 that generates a synchronization signal for use in determining light beam-emitting timing based on image data, and a BD lens 113 attached to the BD 112.

Furthermore, on a drive circuit board of the polygon motor 103, there is disposed a thermistor 116, as a temperature detection unit, which detects the internal temperature of the optical box 101. Note that a lid 114 as a hermetically closing member is mounted to the optical box 101, whereby the optical box 101 is hermetically closed.

In the laser scanner 100 configured as above, a light beam emitted from the light source unit 150 passes through the collimator lens 118 and the cylindrical lens 119 and enters the beam splitter 110. The light beam having entered the beam splitter 110 is split into the first light beam as a transmitted light and the second light beam as a reflected light.

The first light beam is deflected by the polygon mirror 102 and is irradiated onto the photosensitive drum 21 via the first fθ lens 104, the reflection mirrors 105 and 106, the second fθ lens 107, the reflection mirror 108, and the dustproof glass 109, to form an electrostatic latent image on the surface of the photosensitive drum 21. At this time, part of the first light beam passes through the first fθ lens 104, and after being reflected on the reflection mirror 105, it is reflected on a BD mirror, not shown, and passes through the BD lens 113, thereafter entering the BD 112. Upon receipt of the light beam, the BD 112 outputs timing information. A CPU 201 (see FIG. 3) controls timing at which the light beam starts image formation, based on the timing information output from the BD 112.

On the other hand, the second light beam is collected and condensed by the condenser lens 115 and then enters the PD 111 as a photoelectric conversion element (light receiving section). The PD 111 outputs a detection signal corresponding to the amount of received light. The CPU 201 performs automatic power control (APC) based on the detection signal from the PD 111.

Figure 3:
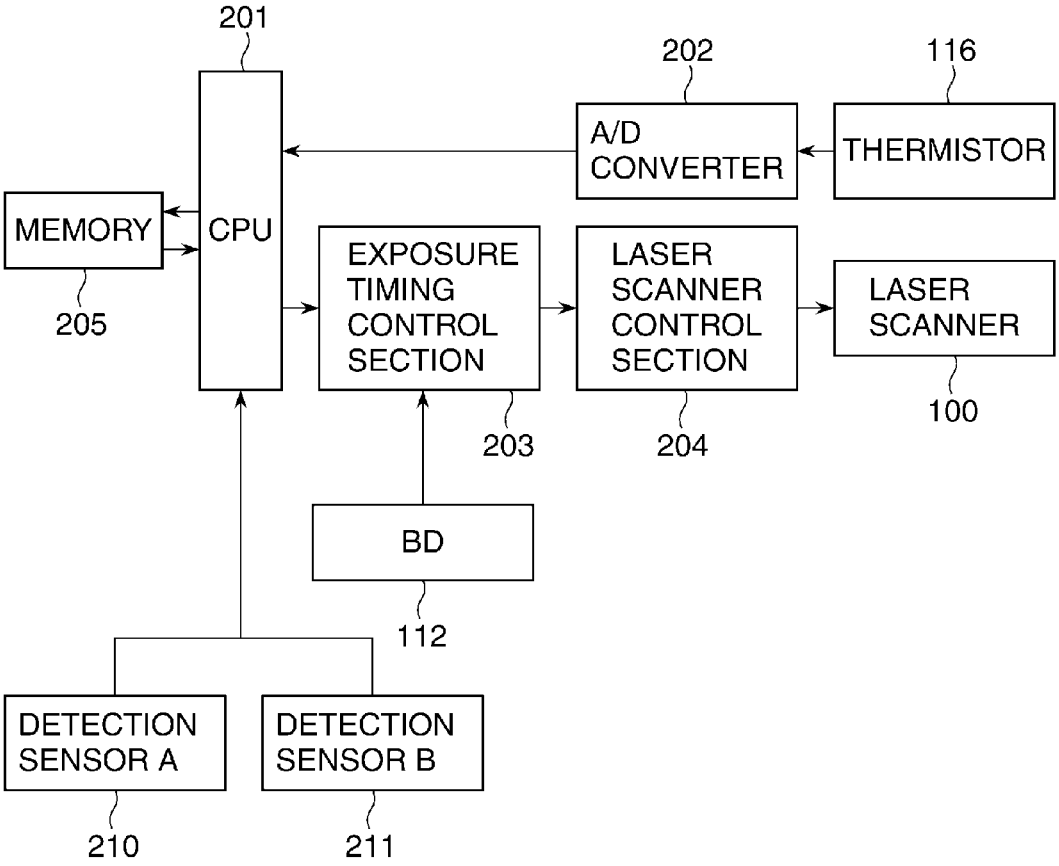
FIG. 3 is a control block diagram of the image forming apparatus.

FIG. 3 is a block diagram useful in explaining a control configuration for predictive correction control performed in the scanning optical device shown in FIGS. 2A and 2B. As shown in FIG. 3, the CPU 201 is communicably connected to the thermistor 116 via an analog-to-digital converter 202. Further, the CPU 201 is communicably connected to the laser scanner 100 via an exposure timing control section 203 and a laser scanner control section 204. The CPU 201 is communicably connected to a memory 205 as well.

An internal temperature of the optical box 101, which was detected by the thermistor 116, is input as a detected temperature to the CPU 201 via the analog-to-digital converter 202 provided in the image forming apparatus. The CPU 201 calculates an amount of rise in the internal temperature (temperature change amount) based on the detected temperature acquired via the analog-to-digital converter 202 and a reference temperature stored in the memory 205 and then corrects the color misregistration based on the calculated amount of rise in the internal temperature. Further, the CPU 201 performs determination as to whether or not the internal temperature of the optical box 101 has been sharply lowered by the start of rotation of the polygon mirror 102 driven in timing synchronous with the startup of the laser scanner 100, and updating of the reference temperature.

Further, the CPU 201 is connected to two detection sensors (the detection sensor A 210 and, the detection sensor B 211) each formed by an optical sensor comprised of a light emitter and a light receiver, not shown, for detecting a detection pattern, referred to hereinafter.

In the following, a description will be given of an image forming process performed by the image forming apparatus 10 provided with the laser scanner (scanning optical device) 100 shown in FIGS. 2A and 2B.

Figure 4:
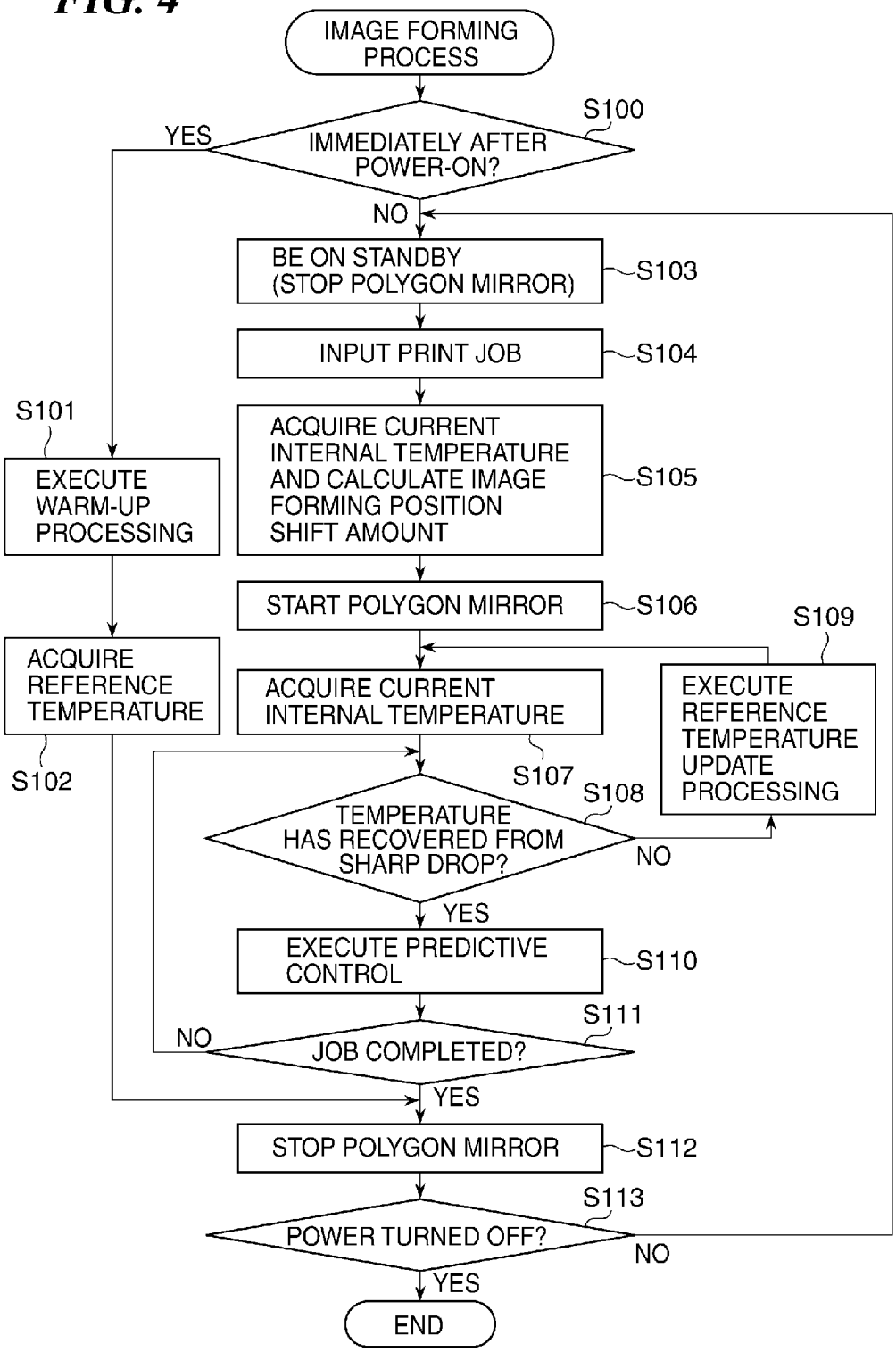
FIG. 4 is a flowchart of an image forming process performed by the image forming apparatus.

FIG. 4 is a flowchart of the image forming process performed by the image forming apparatus 10 provided with the laser scanner (scanning optical device) 100 shown in FIGS. 2A and 2B. The CPU 201, as a controller, performs the image forming process by executing a program therefor which is stored in the memory 205.

Referring to FIG. 4, when the image forming process is started, first, the CPU 201 determines whether or not it is immediately after power-on of the image forming apparatus 10 provided with the laser scanner 100 (step S100). If it is immediately after power-on of the image forming apparatus 10 (YES to the step S100), the CPU 201 executes warm-up processing (step 5101) to thereby make preparations for forming an excellent image. Here, it is assumed that the laser scanner 100 is turned on simultaneously with turn-on of the power of the image forming apparatus 10. The warm-up processing includes measurement processing for measuring a detection pattern formed on the intermediate transfer belt 23 (detection pattern measurement processing) and other various kinds of correction processing. Based on the result of the measurement of the detection pattern, the CPU 201 detects the amount of shift of the image forming position in a conveying direction (sub scanning direction) in which the intermediate transfer belt 23 conveys a toner image and the amount of shift of the image forming position in a direction (main scanning direction) orthogonal to the conveying direction. Note that the main scanning direction is a direction in which a light beam scans the photosensitive drum 21, and corresponds to the direction orthogonal to the conveying direction of the intermediate transfer belt 23. On the other hand, the sub scanning direction is a direction in which the photosensitive drum 21 rotates, and corresponds to the conveying direction of the intermediate transfer belt 23.

Next, the CPU 201 acquires a temperature of the thermistor 116 detected after termination of the warm-up processing, as a reference temperature (step S102). Then, the CPU 201 stops the polygon motor 103 having started driving the polygon mirror 102 simultaneously with turn-on of the power of the image forming apparatus 10, to thereby stop rotation of the polygon mirror 102 (step S112). Thereafter, on condition that the power of the image forming apparatus 10 has not been turned off by a user (NO to a step S113), the CPU 201 proceeds to a step 5103, wherein the CPU 201 enters a standby state and awaits input of image data. A state in which each unit is controlled based on image data is referred to as an image forming state, and a state in which each unit is ready to start image formation upon input of image data is referred to as the standby state. During execution of the warm-up processing, execution of the image forming process is inhibited, and the correction processing is performed. In the standby state, the polygon mirror 102 is held in stoppage. The image forming apparatus 10 makes it possible to make power consumption smaller in the standby state than in the image forming state or in a state in which the warm-up processing is being executed.

On the other hand, if it is determined in the step 5100 that it is not immediately after power-on of the image forming apparatus 10 (NO to the step S100), the CPU 201 shifts to the standby state and awaits input of image data (step S103). Then, when image data is input (step S104), the CPU 201 acquires a temperature detected by the thermistor 116 as a current internal temperature, and calculates an image forming position shift amount (an amount of the color misregistration A) by the detection pattern measurement processing (step S105).

In the following, a description will be given of the detection pattern measurement processing. The detection pattern measurement processing is performed, on condition that the internal temperature of the optical box 101 is in a predetermined range of stable temperature, according to a user instruction from a console section, not shown, or at predetermined time intervals, and the result of the measurement is stored in the memory 205 for use in image formation processing described hereinafter. Further, the detection temperature measured by the thermistor 116 at this time is stored in the memory as the reference temperature, and is used for determining the amount of rise in the internal temperature.

Figure 5:
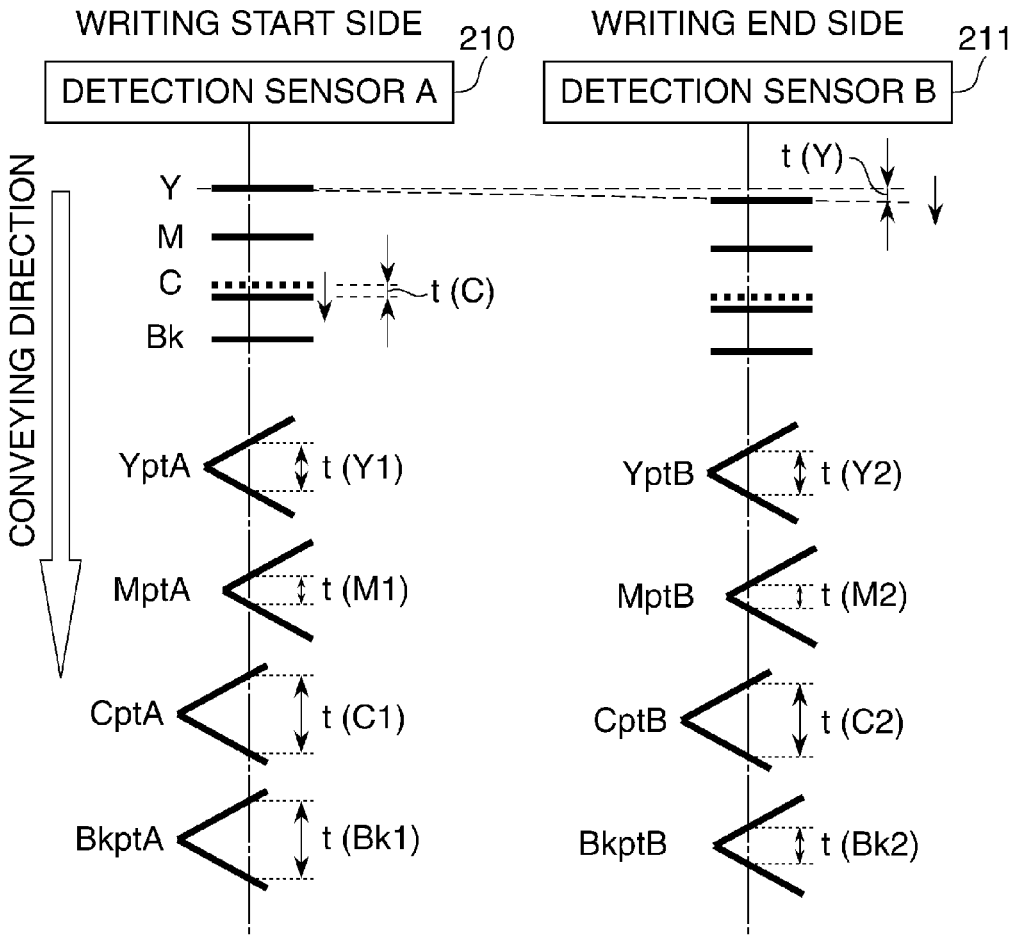
FIG. 5 is a diagram of an example of a detection pattern formed on an intermediate transfer belt.

FIG. 5 is a schematic view of a detection pattern formed on the intermediate transfer belt 23.

The detection pattern includes pairs of line segments and pairs of V-shaped patterns. The pairs of line segments and the pairs of V-shaped patterns are formed on the photosensitive drum 21 using yellow, magenta, cyan, and black toners, and are then transferred onto the intermediate transfer belt 23 such that the line segments and patterns of each pair are formed with a predetermined space therebetween in the direction orthogonal to the conveying direction of the intermediate transfer belt 23. The detection pattern is detected by the aforementioned two detection sensor A 210 and detection sensor B 211 (see FIG. 3) each formed by the optical sensor comprised of the light emitter and the light receiver. The two detection sensor A 210 and detection sensor B 211 are arranged at respective detection positions spaced from each other by a predetermined distance in the direction (main scanning direction) orthogonal to the conveying direction of the intermediate transfer belt 23 (sub scanning direction) such that they are opposed to respective pattern forming positions on the intermediate transfer belt 23 in the main scanning direction where the detection patterns are formed. As the intermediate transfer belt 23 conveys the detection patterns in the conveying direction, each pair of line segments and V-shaped patterns passes an associated one of the detection position on the intermediate transfer belt 23 irradiated with light from the light emitters of the respective detection sensor A 210 and detection sensor B 211. The reflectivity of the detection pattern is higher than that of the intermediate transfer belt 23, so that when the detection pattern reaches the detection position, the intensity of light received by the light receiver increases, and an output signal from the detection sensor exceeds a threshold value. In short, the CPU 201 detects the detection pattern based on timing in which the output signal from the detection sensor exceeds the threshold value.

The CPU 201 calculates a difference t(Y) between timing at which one line segment corresponding to a main scanning start side of main scanning performed by a light beam on the photosensitive drum 21 was detected by the detection sensor A 210 and timing at which the other line segment corresponding to a main scanning end side of the main scanning was detected by the detection sensor B 211. The time difference t(Y) is multiplied by the conveying speed of the transfer belt, whereby the angle of inclination of a yellow image is calculated. A time difference t(C) represents a difference between timing for detection of a cyan line segment, which could be predicted based on timing at which a magenta line segment was detected, and timing at which the cyan line segment was actually detected. By multiplying the time difference t(C) by the conveying speed of the transfer belt, it is possible to calculate the amount of shift of a cyan toner image forming position relative to a magenta toner image forming position in the sub scanning direction (conveying direction).

On the other hand, each V-shaped pattern is used for detection of the amount of shift of an image forming position in the main scanning direction (direction orthogonal to the conveying direction). During passage of a V-shaped pattern over the detection position, the output signal from each detection sensor exceeds the threshold value twice. The amount of shift of one image forming position in the main scanning direction can be determined based on a product of a time period t(Y1), t(M1), t(C1), or t(Bk1) between detection of one line segment of the corresponding V-shaped pattern and detection of the other line segment of the same, and tanθ. Note that θ represents an angle formed by each line segment of a V-shaped pattern and the transfer belt conveying direction.

For example, FIG. 5 shows, for example, that a detection time period t(Y1) of a yellow image-associated V-shaped pattern YptA corresponding to the main scanning start side and a detection time period t(Y2) of a yellow image-associated V-shaped pattern YptB corresponding to the main scanning end side are each equal to each other, that is, there is no difference between the left and right detection time periods, and hence they are each equal to an ideal detection time period (reference time). Therefore, in this case, it is judged that the magnification in design of the yellow image is equal to a target magnification and the main scanning start position in the main scanning direction is a target position. On the other hand, a detection time period t(M1) of a magenta image-associated V-shaped pattern MptA corresponding to the main scanning start side is shorter than the reference time, and a detection time period t(M2) of a yellow image-associated V-shaped pattern YptB corresponding to the main scanning end side is also shorter than the reference time. Therefore, it is judged that the magenta image is shifted rightward as viewed in FIG. 5. As for cyan image-associated V-shaped patterns CptA and CptB, a detection time period t(C1) of the V-shaped pattern CptA corresponding to the main scanning start side is longer than the reference time, and a detection time period t(C2) of the V-shaped pattern CptB corresponding to the main scanning end side is also longer than the reference time. Therefore, it is judged that the cyan image is shifted leftward as viewed in FIG. 5. As for black image-associated V-shaped patterns BkptA and BkptB, a detection time period t(Bk1) of the V-shaped pattern BkptA corresponding to the main scanning start side is longer than the reference time, and a detection time period t(Bk2) of the V-shaped pattern BkptB corresponding to the main scanning end side is shorter than the reference time. Therefore, it is judged that the black image is expanded both leftward and rightward, as viewed in FIG. 5, and the image magnification thereof is increased.

Then, the CPU 201 corrects the color misregistration by referring to a predetermined table based on the inclination of the scanning line, the amount of shift of the image forming position in the sub scanning direction, the amount of shift of the image forming position in the main scanning direction, and the image magnification, which were obtained as results of the detection pattern measurement.

However, the inclination of the scanning line, the amount of shift of the image forming position in the sub scanning direction, the amount of shift of the image forming position in the main scanning direction, and the image magnification change with time in accordance with temperature rise in the laser scanner 100.

Figure 6:
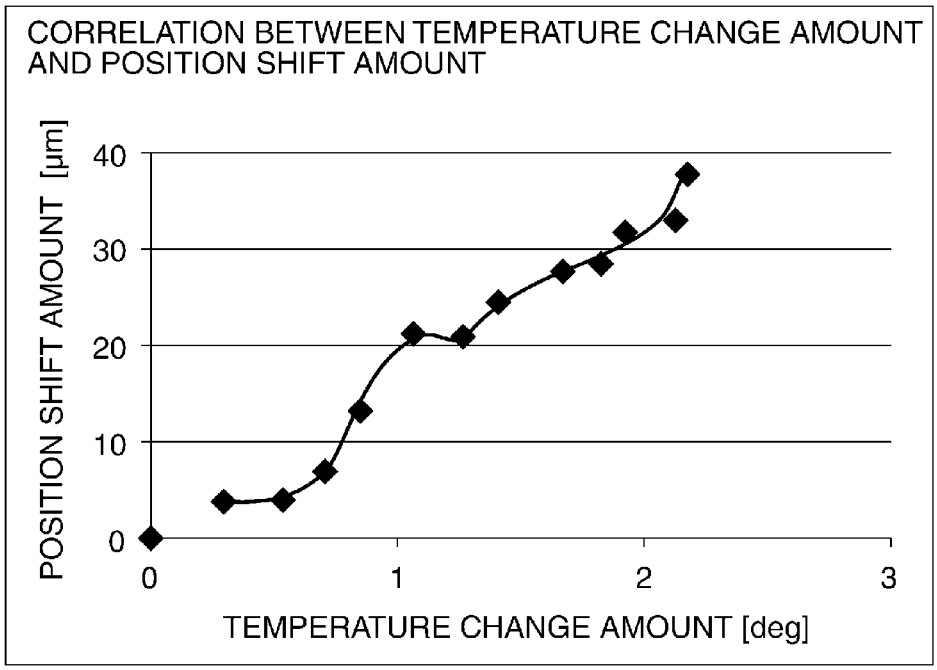
FIG. 6 is a diagram showing a correlation between a change amount (deg) of a detected temperature and a change amount (pm) of an image forming position.

FIG. 6 is a diagram showing the relationship between a temperature change amount (deg) of the scanning optical device (laser scanner) 100 and an image forming position shift amount (pm) in the sub scanning direction. It is understood from FIG. 6 that the image forming position shift amount (pm) in the sub scanning direction changes according to the temperature change amount (deg) of the laser scanner 100 with a linear correlation therebetween. Therefore, the image forming position shift amount (an amount of the color misregistration B) in the sub scanning direction is predicted based on a temperature difference (the amount of rise in the internal temperature) between the detected temperature from the thermistor 116 and the reference temperature, and the FIG. 6 correlation table. Then, a total image forming position shift amount is determined by adding the shift amount of the image forming position in the sub scanning direction which is determined based on the result of the detection pattern measurement on condition that the detection temperature of the optical box 101 is the predetermined range of stable temperature and is stored in the memory 205, to the shift amount predicted based on the amount of rise in the internal temperature, and the color misregistration is corrected such that the total image forming position shift amount is corrected. An image forming position shift amount (an amount of the color misregistration B) in the main scanning direction is predicted based on the same method as described above.

However, immediately after the start of rotation of the polygon mirror 102, airflow is generated in the optical box 101 and the temperature of air filling the internal space of the optical box 101 (hereinafter simply referred to as "the internal temperature") is temporarily lowered. At this time, there is no decrease in the temperature of the optical box 101 and those of respective optical members arranged in the optical box 101. Therefore, when the color misregistration is corrected based on the internal temperature detected by the thermistor 116 as a temperature sensor, control error occurs. A main factor that changes the exposure position of a light beam is thermal expansion of the optical box 101 or the optical members, but even if only the internal temperature slightly changes due to generation of airflow, the temperature of the optical box 101 and those of the respective optical members, such as lenses, hardly change, and therefore thermal expansion does not occur.

Figure 7:
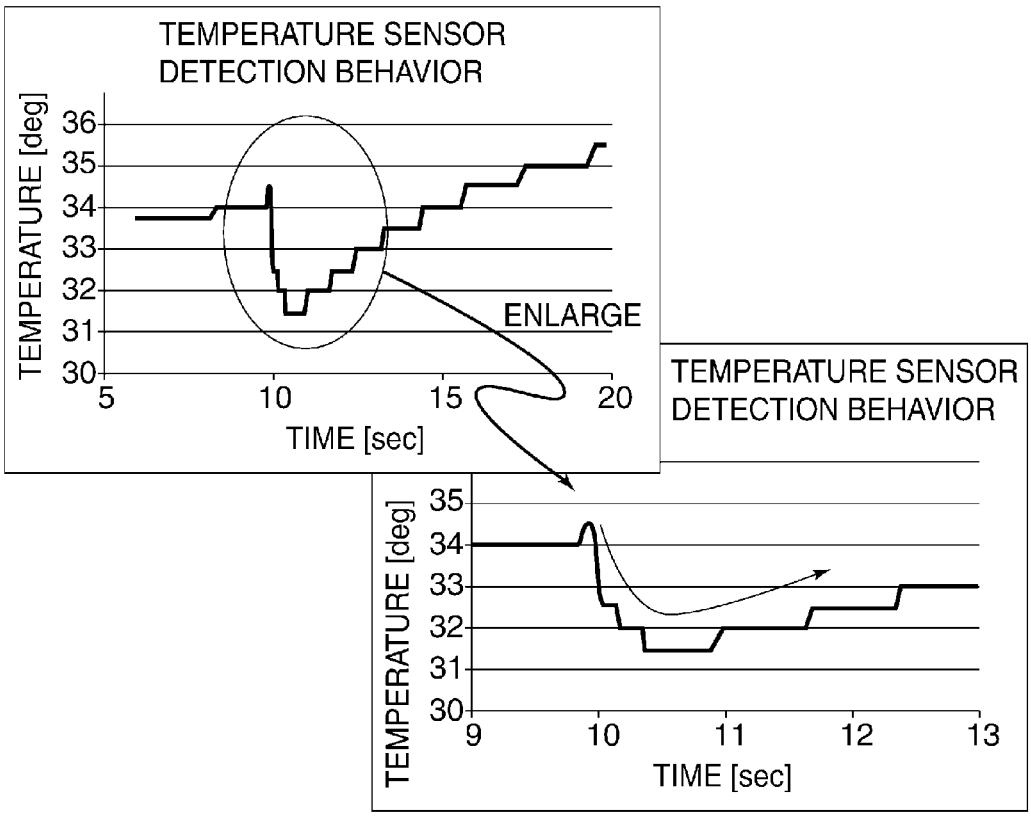
FIG. 7 is a diagram showing the relationship between the rotation time of a polygon mirror and an internal temperature.

FIG. 7 is a diagram showing the detection behavior of the temperature sensor in the laser scanner (scanning optical device) 100 before and after the start of rotation of the polygon mirror. As shown in FIG. 7, the internal temperature is held substantially constant before the start of rotation of the polygon mirror 102, whereas it sharply drops immediately after the start of rotation of the polygon mirror 102. The sharp drop of the internal temperature occurs when airflow is generated by rotation of the polygon mirror 102 and cool air in the vicinity of the lid 114 or the inner wall surfaces of the optical box 101 flows into the vicinity of the thermistor 116, and is detected by the thermistor 116. The internal temperature which sharply dropped temporarily is stabilized by circulation of internal air and then gradually rises. The temporary drop of the internal temperature and the recovery of the same from the temporary drop are apparent changes which occur in the internal temperature alone without accompanying drop or rise in the temperature of the optical box 101 and those of the optical members. Therefore, the changes in the internal temperature by no means lead to a change in the exposure position. The amount of the temperature drop immediately after the start of rotation of the polygon mirror 102 is not fixed, but it generally varies within a range of 3 to 4 degrees, depending on the internal temperature of the optical box 101 or the ambient temperature. A time period over which the internal temperature is held lower than the reference temperature acquired in the step 5102 is e.g. several seconds to one minute.

In view of the above-described phenomena peculiar to a laser scanner, in the present embodiment, the internal temperature of the optical box 101 is detected again immediately before the predictive control of color registration adjustment is started.

Referring again to FIG. 4, after having calculated the amount of the color misregistration A by the detection pattern measurement processing in the step S105, the CPU 201 starts the polygon motor 103 to rotate the polygon mirror 102 (step S106). At this time, airflow is generated in the optical box 101 by rotation of the polygon mirror 102, whereby the internal temperature drops sharply. Then, the CPU 201 acquires the internal temperature detected immediately after the start of rotation of the polygon mirror 102, as a current internal temperature (step S107). Thereafter, the CPU 201 determines whether or not the internal temperature of the optical box 101 has been recovered from the sharp drop (step S108). If it is determined in the step S108 that the internal temperature has not been recovered from the sharp drop (NO to the step S108), the CPU performs reference temperature update processing (step S109).

The reference temperature update processing is performed when the internal temperature of the optical box 101 temporarily drops sharply due to the start of rotation of the polygon mirror 102, so as to update the reference temperature until the internal temperature recovers from the sharp drop, such that there is no difference between the detected temperature and the reference temperature. More specifically, the reference temperature set for calculation of the temperature change amount in predictive control is controlled such that the temperature change amount is held equal to 0 (deg) until the internal temperature recovers from the sharp drop. The reference temperature update processing is stopped at a time point when the internal temperature recovers from the sharp drop (steps S109, S107, and S108). This prevents the amount of rise in temperature from being changed until the internal temperature recovers from the sharp drop, so that the predictive correction control is restricted, which makes it possible to prevent occurrence of a control error due to execution of the predictive correction control based on an apparent temperature rise from a temperature apparently dropped without accompanying the temperature drop of the optical box 101 and those of the optical members.

On the other hand, when sharp drop of the internal temperature of the laser scanner does not occur or when the internal temperature recovers from the sharp drop, the CPU 201 performs a toner image forming operation based on image data (step S110). In the step S110, the CPU 201 performs the color registration adjustment based on the sum of the amount of the color misregistration A and the amount of the color misregistration B. Note that the color registration adjustment is achieved by adjusting the image formation timing of the exposure device or correcting the image data such that the image forming position becomes a target position. The color registration adjustment based on the amount of the color misregistration A alone is a known art. According to the present invention, the color registration adjustment is performed based on the amount of the color misregistration A and the amount of the color misregistration B. The CPU 201 acquires the internal temperature each time one page of image is formed, and forms a toner image. Next, the CPU 201 determines whether or not formation of toner images for all pages based on the image data has been completed (step S111). If it is determined in the step S111 that formation of toner images for all pages based on the image data has not been completed, the process returns to the step S108.

On the other hand, if it is determined in the step S111 that formation of toner images for all pages based on the image data has been completed, the CPU 201 stops the polygon motor 103 to stop rotation of the polygon mirror 102 (step S112). Then, the CPU 201 determines whether or not the power of the image forming apparatus has been turned off by the user (S113). If the power has not been turned off (NO to the step S113), the CPU 201 returns to the step 5103, whereas if the power has been turned off (YES to the step S113), the CPU 201 terminates the present process.

According to the FIG. 4 process, when the internal temperature of the optical box 101 is temporarily lowered by airflow generated by the start of rotation of the polygon mirror 102 as a rotary member, the reference temperature is updated such that the temperature change amount is held equal to 0 (deg) until the internal temperature recovers from the temporary drop. In other words, the amount of the color misregistration B is made equal to 0. As a consequence, even when the internal temperature rises from a temperature to which it is temporarily dropped, the predictive correction control for correcting the color misregistration is not executed until the internal temperature recovers from the temporary drop, so that it is possible to prevent occurrence of a control error due to execution of the predictive correction control based on an apparent temperature rise without accompanying the temperature rise of the optical box 101 and those of the optical members. Further, since the predictive correction control can be appropriately performed, it is possible to form excellent images from the start of toner image formation based on image data.

In the present embodiment, the term "exposure position (irradiation position)" is intended to mean an irradiation position e.g. on the surface of the photosensitive drum 21 or light emission timing for emitting each light beam in the main scanning direction when a multi-beam light source is used.

In the present embodiment, it is preferable that the thermistor 116 as a unit for detecting the internal temperature of the optical box 101 is disposed in the vicinity of the polygon mirror 102, e.g. on the drive circuit board of the polygon mirror 102. The temperature change amount is large on the drive circuit board of the polygon motor 103, and therefore it is possible to detect a change in the internal temperature more accurately. More preferably, the thermistor 116 is disposed in an area defined by the wall surfaces of the casing surrounding the polygon mirror 102 and the fθ lens 104 as a first imaging lens. This area is where the temperature change (rise) amount is largest in the laser scanner 100, so that it is possible to maintain a favorable S/N ratio by reducing temperature detection sensitivity of control.

Note that in general in an image forming apparatus, when a plurality of imaging lenses (fθ lenses) are arranged on an optical path downstream of the polygon mirror 102, a first imaging lens disposed at a location close to the polygon mirror 102 has a refracting power acting in the main scanning direction. The first imaging lens, which is disposed in the vicinity of the polygon mirror 102, is susceptible to heat from the polygon mirror 102. When the first imaging lens is heated, there can be caused a magnification change, a writing start position shift, and an exposure position shift between multi-beams due to change in partial magnification of each beam. However, in the present embodiment, shift correction (registration correction) control based on a change in the internal temperature is restricted during a predetermined time period after the start of rotation of the polygon mirror 102, so that it is possible to prevent occurrence of the control error immediately after the startup of the apparatus as well.

Although in the above description, execution of the predictive control of the color registration adjustment is inhibited, this is not limitative, but execution e.g. of correction processing for correcting relative dot position shift between beams may be inhibited.

The following description will be given of a case where the present invention is applied to the correction processing for correcting relative dot position shift between beams.

Figure 8A:
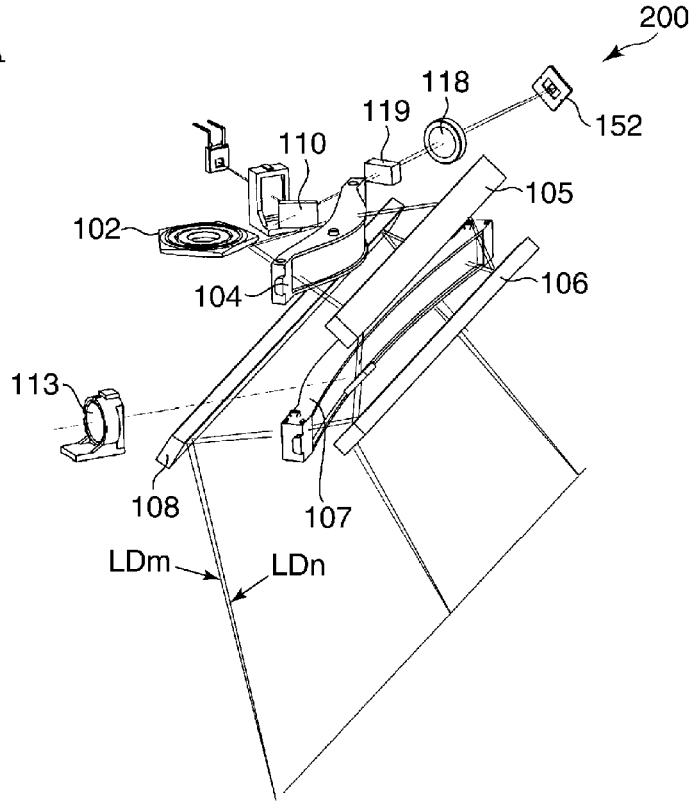
FIG. 8A is a schematic perspective view of essential parts of the scanning optical device equipped with a multi-beam light source.
Figure 8B:
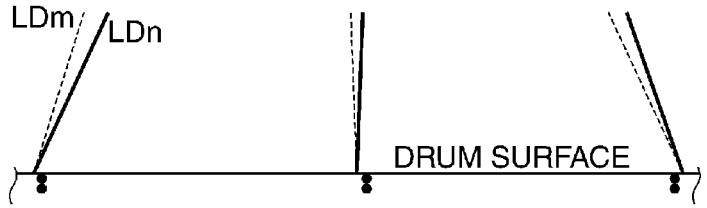
FIG. 8B is a view showing a beam light path and an imaging position before a temperature rise.
Figure 8C:
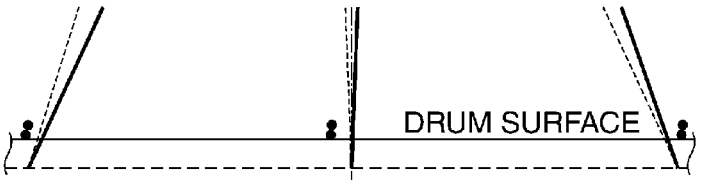
FIG. 8C is a view showing the beam light path and the imaging position after the temperature rise.

FIGS. 8A to 8C are views useful in explaining a scanning optical device equipped with a multi-beam light source. FIG. 8A is a perspective view of essential parts of the device, FIG. 8B is a view showing a beam optical path and an imaging position before a temperature rise, and FIG. 8C is a view showing a beam optical path and an imaging position after the temperature rise.

The main arrangement of a laser scanner 200 shown in FIG. 8A is the same as that of the laser scanner 100 shown in FIGS. 2A and 2B, and therefore description thereof is omitted.

Light beams emitted from a laser light source 152 having a plurality of light emitters pass through the collimator lens 118, the cylindrical lens 119, and the beam splitter 110, and enter the polygon mirror 102, which deflects the light beams. The light beams deflected by the polygon mirror 102 are scanned on the photosensitive drum 21 via the first fθ lens 104, the reflection mirrors 105 and 106, the second fθ lens 107, and the reflection mirror 108, to form an electrostatic latent image on the surface of the photosensitive drum 21.

Referring to FIGS. 8B and 8C, which show the light paths of the respective light beams for scanning the surface of the photosensitive drum 21, assuming that no optical focus shift has occurred in the main scanning direction, an m-th laser LDm and an n-th laser LDn reach the surface of the photosensitive drum 21 via respective different optical paths. For this reason, a laser scanner equipped with a multi-beam light source is generally controlled before factory shipment by measuring differences in passing time between the beams in advance and controlling the light emission timing of each beam based on the differences in passing time, such that the dot positions of the respective beams are aligned. The light emission timing of each beam is measured before the factory shipment when the temperature of each of the component parts has not risen yet. Therefore, before the temperature of the laser scanner rises, dots are disposed at respective image positions on the surface of the photosensitive drum 21 in an aligned manner as shown in FIG. 8B, by causing the laser scanner to emit light based on the light emission timing measured in advance.

On the other hand, when the internal temperature of the image forming apparatus rises due to rotation of the polygon mirror and heat sources within the apparatus, the focus position of the laser scanner is changed e.g. due to thermal expansion of each member or change in the refractive index of an optical member. The light emission timing is measured in advance in a factory before the internal temperature of the image forming apparatus rises, i.e. in a state in which focus shift has not occurred, and hence after occurrence of focus shift, even when light is emitted based on the light emission timing, dots are aligned at positions to which the focus has shifted, as shown in FIG. 8C. It is desirable that the relative dot positions of respective beams are vertically aligned on the surface of a photosensitive drum, i.e. that there is no shift in the main scanning direction. However, when a temperature rise causes a focus shift, a relative dot position shift between the beams in the main scanning direction occurs on the surface of the photosensitive drum 21. The dot position shift causes periodical variation in the exposure position, and therefore interference with a screen in use is likely to occur, which can cause image moire.

Figure 9:
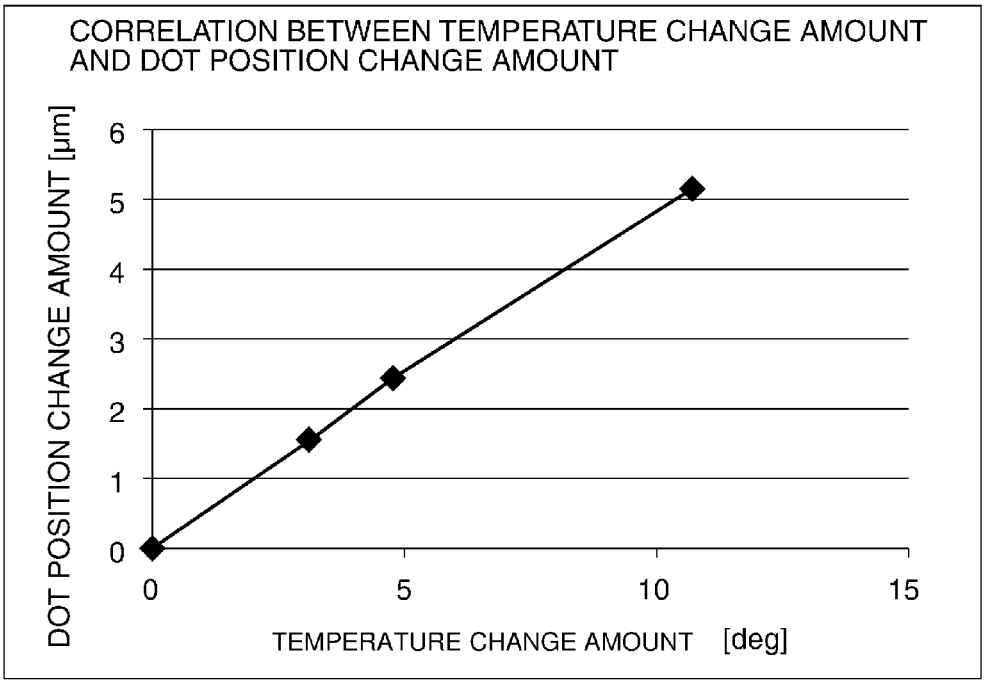
FIG. 9 is a diagram showing a correlation between the amount of change in temperature of the scanning optical device and the amount of change in relative irradiation position between beams.

FIG. 9 is a diagram showing a correlation between the amount of change in the internal temperature of the laser scanner 200 and the amount of change in the relative dot position between the beams in the main scanning direction. As shown in FIG. 9, a dot position change amount (pm) in the main scanning direction is linearly correlated with an internal temperature change amount (deg), and therefore it is understood that predictive control can be performed based on a change in the internal temperature, using the thermistor, similarly to the case of the predictive control of the color registration adjustment.

However, since the internal temperature temporarily drops due to generation of airflow immediately after the start of rotation of the polygon mirror 102, a control error occurs if correction is performed based on a temperature detected immediately after the start of rotation of the polygon mirror 102. In the present embodiment, when the detected temperature temporarily drops immediately after the start of rotation of the polygon mirror 102, the reference temperature for use in calculating the amount of rise in the internal temperature is updated in a manner following up the rise in the detected temperature until the temperature recovers from its temporary drop, so as to prevent occurrence of a control error due to the detected temperature immediately after the start of rotation of the polygon mirror 102. As a consequence, the temperature change amount is held equal to 0 (deg) until the detected temperature recovers from the temporary drop immediately after the start of rotation of the polygon mirror 102, whereby the predictive correction control for correcting the relative dot position shift between the beams is restricted and occurrence of a control error is prevented. A dot position shift correction-restricting process is executed following the same sequence as shown in FIG. 4.

Although in the present embodiment, the reference temperature is updated until the detected temperature recovers from its temporary drop, the configuration may be such that the predictive control is performed when it is determined that a temperature detected at predetermined time intervals has risen.

According to the dot position shift correction-restricting process, the reference temperature is updated during a time period from temporary drop of the internal temperature due to generation of airflow immediately after the start of rotation of the polygon mirror 102 to recovery of the internal temperature from the temporary drop, such that the amount of rise in the internal temperature is equal to 0 (deg). This restricts execution of the predictive correction control until the internal temperature recovers from its drop, and hence it is possible to prevent occurrence of a control error in the predictive correction control to thereby maintain excellent image formation.

Although in the above-described embodiment, the thermistor 116 mounted on the drive circuit board of the polygon motor is employed as a sensor for detecting the internal temperature, this is not limitative, but it is possible to employ a thermocouple affixed e.g. to the periphery of the polygon motor or the fθ lens, for example. Further, the arrangement of the optical members in the laser scanner is not particularly limited, but insofar as a rotary member, such as a polygon mirror, is employed, any optical arrangement of the members is allowed.

Furthermore, a control operation to be restricted is not limited to the predictive control of the color registration adjustment or the correction of dot position shift between beams, but it is possible to control any control operation for correcting any characteristic value that changes in accordance with temperature rise and can be corrected by changing the exposure timing of the laser scanner. What is more, the correlation between a characteristic value to be controlled and the temperature is not limited to the above-described linear correlation, but insofar as one correction amount can be determined with respect to the amount of rise in the internal temperature, the correlation may be curved or of any other form.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-088457 filed Apr. 22, 2014 which is hereby incorporated by reference herein in its entirety.

What is claimed is:

1. An image forming apparatus comprising:

an image forming unit that includes a plurality of photosensitive members and an exposure device for exposing each of the photosensitive members to form an electrostatic latent image thereon, and is configured to form a plurality of toner images by developing the electrostatic latent images formed on the respective photosensitive members by the exposure device;

an image bearing member onto which the plurality of toner images formed by the image forming unit are transferred;

a sensor configured to sense a temperature of the exposure device;

a measurement unit configured to measure a measurement image formed on the image bearing member;

a first determination unit configured to control the image forming unit to form the measurement image on the image bearing member, control the measurement unit to measure the measurement image, and determine a first registration adjustment condition based on a result of measurement by the measurement unit;

a second determination unit configured to determine a second registration adjustment condition based on a reference temperature and a first temperature sensed by the sensor;

a controller configured to execute registration adjustment processing for the toner images based on the first registration adjustment condition determined by the first determination unit in a case where the first temperature is lower than a second temperature sensed by the sensor, and execute the registration adjustment processing for the toner images based on the first registration adjustment condition determined by the first determination unit and the second registration adjustment condition determined by the second determination unit in a case where the first temperature is not lower than the second temperature; and an updating unit configured to update the reference temperature in a case where the first temperature is lower than the second temperature, wherein the sensor senses the first temperature while the image forming unit is forming the toner images, and wherein the sensor senses the second temperature before the image forming unit forms the toner images.

2. The image forming apparatus according to claim 1, wherein the exposure device includes:

a light source configured to emit a light beam;

a rotating polygon mirror configured to deflect the light beam such that the deflected light beam scans a photosensitive member;

a motor configured to drive the rotating polygon mirror; and an optical box in which the rotating polygon mirror and the motor are disposed, and wherein the sensor is disposed within the optical box.

3. The image forming apparatus according to claim 2, wherein the sensor is disposed on a drive circuit board of the rotary polygon mirror.

4. The image forming apparatus according to claim 2, wherein the light source has a plurality of light emitters, and wherein the controller corrects relative dot position shift that occurs during scanning of a surface of the photosensitive member by a plurality of light beams emitted from the respective light emitters, based on the first registration adjustment condition and the second registration adjustment condition.

5. The image forming apparatus according to claim 2, wherein the controller corrects exposure timing of the light beams in a main scanning direction of the photosensitive member.

6. The image forming apparatus according to claim 2, wherein the sensor senses the first temperature after the rotary polygon mirror has started to drive.

7. The image forming apparatus according to claim 6, wherein the registration adjustment processing includes processing for adjusting a position of an image to be formed on the image bearing member.

8. The image forming apparatus according to claim 6, wherein the first registration adjustment condition is an amount of shift between image forming positions, which is determined based on a difference in timings at which the measurement unit measures measurement patterns formed on the image bearing member, and the second registration adjustment condition is an amount of shift between the image forming positions, which is predicted based on the first temperature and the reference temperature.

9. The image forming apparatus according to claim 6, wherein the image bearing member is an intermediate transfer belt for transferring an image onto a sheet.

10. The image forming apparatus according to claim 1, wherein the reference temperature is corresponded to the temperature sensed by the sensor when a power switch of the image forming apparatus is pressed.

* * * * *